United States Patent [19]

Ridgeway

[11] Patent Number: 4,932,082

[45] Date of Patent: Jun. 12, 1990

[54] STRAINER CUP FOR POP-UP DRAIN PLUG

[76] Inventor: William V. Ridgeway, 265 Redondo Ave., Long Beach, Calif. 90803

[21] Appl. No.: 380,777

[22] Filed: Jul. 18, 1989

Related U.S. Application Data

[63] Continuation of Ser. No. 158,593, Feb. 22, 1988, abandoned.

[51] Int. Cl.[5] ..... E03C 1/26

[52] U.S. Cl. ..... 4/287

[58] Field of Search ..... 4/286–292

[56] References Cited

U.S. PATENT DOCUMENTS

| | | | |
|---|---|---|---|
| 243,648 | 6/1881 | Stimpson . | |
| 1,203,530 | 10/1916 | Gessler | 4/286 |
| 1,696,505 | 12/1928 | Settles . | |
| 1,720,149 | 7/1929 | Rom | 4/287 |
| 1,770,639 | 7/1930 | West et al. | 4/286 |
| 1,773,547 | 8/1930 | Robertson | 4/287 |
| 2,075,443 | 3/1937 | Kirschner . | |
| 2,077,516 | 4/1937 | Dart . | |
| 2,220,722 | 11/1940 | Millard . | |
| 2,331,055 | 10/1943 | Smith . | |
| 3,071,781 | 1/1963 | Seewick . | |
| 3,959,831 | 6/1976 | Hendricks | 4/287 |
| 3,972,078 | 8/1976 | Maki | 4/292 X |
| 4,199,827 | 4/1980 | Tuleja . | |
| 4,207,631 | 6/1980 | Baggey . | |
| 4,380,834 | 4/1983 | Wentz | 4/292 X |

*Primary Examiner*—Charles E. Phillips

*Attorney, Agent, or Firm*—Fulwider, Patton, Lee & Utecht

[57] ABSTRACT

A conventional pop-up drain plug is movable up and down by an actuator system to open and close the entry opening of a drain pipe. The plug includes a cap at one end to seal the opening, a base engagable by the actuator system, and an intermediate portion comprising a finned guide and a stem. An upwardly open strainer cup having a centrally apertured bottom is forced over the plug base and onto the stem. The cup includes small openings to pass drain water, and its rim is dimensioned to fit close to the drain pipe walls so that the cup will catch small articles passing through the drain pipe entry opening, while yet moving upwardly and downwardly with the drain plug.

6 Claims, 2 Drawing Sheets

STRAINER CUP FOR POP-UP DRAIN PLUG

This is a continuation of application Ser. No. 158,593, filed on Feb. 22, 1988, now abandoned.

TECHNICAL FIELD

The present invention relates to a strainer cup which strains drain water without interfering with the normal operation of a pop-up drain plug.

BACKGROUND ART

A pop-up drain plug is typically characterized by a cap at one end to open and close the plug seat or entry opening of the drain pipe. The base at the other end of the plug is acted upon by actuator means which move the plug up and down in the drain pipe. When the plug is up, water is free to flow from the sink, tub or the like, beneath the raised cap of the plug, and through the entry opening into the drain pipe. The water then flows past the intermediate portion of the plug. This portion includes a guide whose radially outwardly directed fins slidably engage the drain pipe walls to guide the plug in its up and down movement. The intermediate portion also includes a stem located between the guide and the plug base. Typically the stem is of a lesser cross section than the guide because there is no need for the fins to extend all the way to the base to insure alignment of the plug with the drain pipe. Also, the fins normally do not extend above the drain entry opening, even in the uppermost position of the plug.

Under these circumstances, small articles such as contact lenses and jewelry items can accidentally be carried into the drain pipe with any water draining into the entry opening. The same is true of foreign substances such as hair, which can eventually clog the drain pipe.

There are surface strainers in the prior art which can be placed adjacent the plug seat or entry opening, flush with the adjacent sink or tub surface, but this cannot be done until the drain plug is removed. Then, when the sink is to be filled, the strainer must be removed and the plug inserted. Emptying the filled sink so that all foreign objects are caught in the strainer is even more challenging because the strainer must be immediately positioned after the plug is removed.

U.S. Pat. No. 1,203,530, entitled "Combination Drainer and Stopper", issued to W. R. Gessler on Oct. 31, 1916, show a surface strainer which can be left in the drain opening at all times. However, the strainer will not work with a pop-up type of drain plug. Each time such a pop-up plug is raised the guide fins on the plug would move up against the strainer and pop it out of the drain opening. Instead of a pop-up drain plug Gessler teaches a sink stopper which completely overlies the strainer. One feature of his strainer is that it is attached to a rod which slides through the center of the strainer A disk-like base on the lower end of the rod engages the underside of the strainer whenever the householder wants to remove the strainer for cleaning. Otherwise, the strainer normally remains in one position, and in no event does it move with the rod.

U.S. Pat. No. 4,380,834 entitled "Pop-Up Plunger", issued on Apr. 26, 1983 to F. E. Wentz, discloses a pop-up drain plug and integral strainer which do move together. The strainer is designed to entrap small articles moving toward the drain opening with the drain water. However, such entrapment occurs before such articles pass through the drain opening. This is done by an apertured sleeve attached to and extending downwardly from the cap of the plug. The sleeve rises with the plug cap and is at all times in the path of the drain water, regardless of the height of the raised plug above the drain opening. Water can pass into the sleeve but small articles cannot. The complete length of the strainer must be precisely dimensioned to closely fit against the drain pipe walls so that small articles cannot fall between the strainer and the drain pipe in any raised position of the plug. As Wentz points out, this necessitates tolerances of two and one half to ten thousandths of an inch between the strainer and the adjacent drain pipe surface, and he indicates it may be necessary "to bore out or ream out the interior of the waste drain pipe." If close tolerances are not observed small articles, and particularly a contact lens, could slip between the strainer and the drain pipe. Needless to say, the installation procedure mentioned would be time consuming and not within the skill of most householders.

DISCLOSURE OF THE INVENTION

According to the present invention, small articles swept along by draining waste water are allowed to pass through the drain opening and into the drain pipe, but they are caught before they pass into or beyond the drain pipe trap. This is accomplished by a strainer cup which, although it can be made integral with the stem of a newly manufactured pop-up drain plug, is preferably retrofitted to the drain plug.

The strainer cup comprises a bottom and a peripherally continuous side wall which define an upwardly open container. The cup is provided with small openings to filter the drain water, and its bottom includes aperture means enabling the cup to be urged upwardly over the drain plug base and onto the plug stem. The material of the cup is preferably resilient to frictionally grip the stem so that the cup moves up and down with the drain plug. At least the upper edge or rim of the side wall closely fits against but is freely slidable relative to the drain pipe walls. Consequently, if small articles carried into the drain pipe they are caught in the strainer cup from which they are can easily be removed by lifting out the drain plug.

The strainer cup can be made of either metal or plastic material and the small openings in the cup can be defined in any suitable way, including fabrication of the cup from fine mesh screen material.

The aperture means in the cup bottom are preferably made so that the cup is "universal" in its ability to fit onto many different types of drain plug stems. The bottom can be provided with a central aperture complementally configured to fit on any particular drain plug stem. Slits extending from the central aperture are preferably also provided so that the aperture edges can be deformed downwardly to form mounting or gripping flaps when the cup is positioned upon the drain plug. Such flaps tend to bite into or grip the external surfaces of the plug stem to constrain the cup against movement and properly center it upon the drain plug.

In all versions the strainer is operative without affecting the normal operation of the usual pop-up drain plug.

Other aspects and advantages of the present invention will become apparent from the following more detailed description taken in conjunction with the accompanying drawings.

BEST MODES FOR CARRYING OUT THE INVENTION

Figure 10:
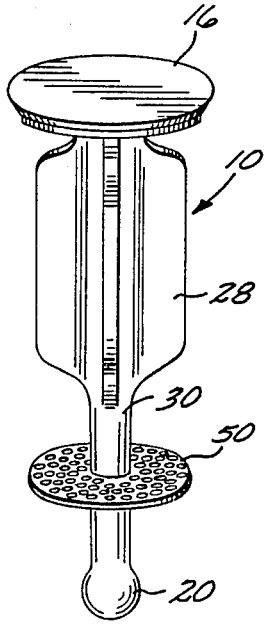
FIG. 10 is a partially diagrammatic view of the strainer cup carried by a drain plug mounted in operative position within a drain pipe and operated by an actuator system.

Referring now to FIG. 10, a typical or conventional pop-up drain plug 10 is illustrated as it would appear installed within the usual generally cylindrical waste drain pipe 12. The drain pipe includes a conical seat or entry opening 14 at its upper end which forms the drain from the associated sink or tub.

The drain plug includes a cap 16 at its upper end which is complementally configured relative to the drain opening seat, and has a larger diameter than the seat, so that when the plug is moved from the upper position illustrated in FIG. 10 to a lower position, the cap 16 engages the seat or margins of the opening 14 and prevents waste water from draining from the sink 18 and into the drain pipe.

The drain plug also includes a base 20 at its opposite or lower end. This is engagable by the free end of a lever 22 which forms part of an actuator system 24. An extension 26 of the lever is connected by suitable linkages (not shown) to a sink knob (not shown) which can be raised or lowered to pivot the lever 22 up and down. This lowers and raises the drain plug, respectively, to close and open the drain opening 14. The weight of the drain plug normally causes it to fall into closed position whenever the lever is down, all as is well known.

The base 20 is most often rounded or bulbous to easily ride upon the free end of the lever 22. However, certain types of drain plug have an enlarged, offset base configured to partially capture a complementally configured lever arm (not shown) of the actuator system. The invention is adapted for association with various types of drain plug, including the offset type.

Figure 7:
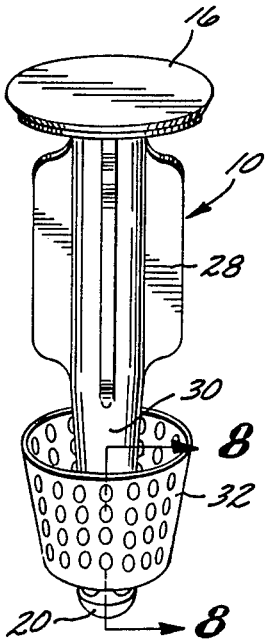
FIG. 7 is a perspective view of the strainer cup of FIGS. 1 and 2 mounted upon a pop-up drain plug.
Figure 8:
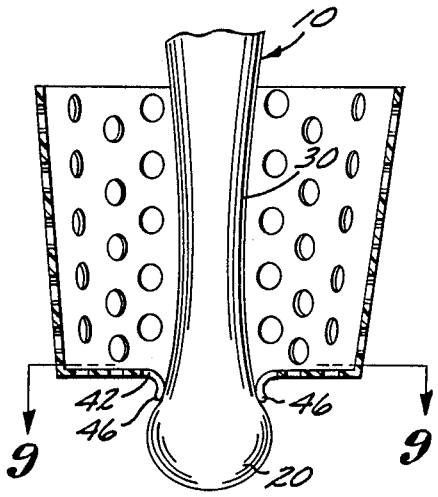
FIG. 8 is a view taken along the line 9—9 of FIG. 8.
Figure 9:
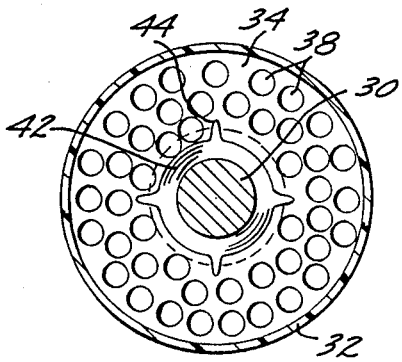
FIG. 9 is an enlarged view taken along the line 8—8 of FIG. 7.

As best seen in FIGS. 7–9, the drain plug includes an intermediate portion comprising a guide 28 located adjacent the cap 16 and characterized by four radially directed and longitudinally extending fins. These engage the inner walls of the drain pipe at their outer extremities to properly orient and guide the drain plug during its up and down movement. Drain water ca flow freely downwardly through the spaces between the fins.

The intermediate portion of the drain plug also includes a elongated stem 30 located between the guide 28 and the base 20. The cross section of the stem is less than that of the guide 28, becoming gradually smaller in a downward direction until it smoothly merges or fairs into the larger cross section of the base 20.

In the raised position of the drain plug an annular space exists between the plug cap 16 and the drain opening 14 which is sufficiently large for small articles such as jewelry items and contact lenses to pass with drain water into the drain pipe. Ordinarily such items end up in the usual drain trap and, since access to the trap is difficult, they are frequently abandoned, or even lost if they are not lodged in the trap. Hair and other foreign substances also pass into the drain trap in this manner, and eventually clog the drain. The cup strainer 32 of the present invention prevents this.

Figure 1:
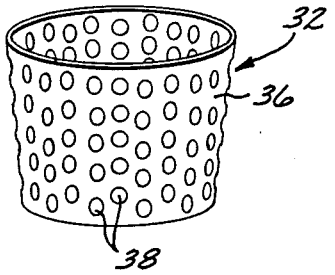
FIG. 1 is a perspective view taken from above of the present strainer cup.
Figure 2:
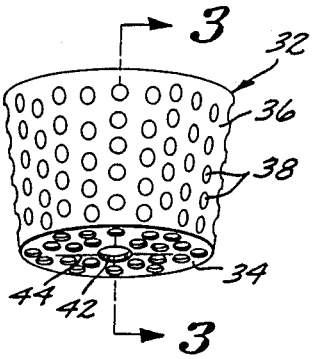
FIG. 2 is a perspective view taken from below of the cup of FIG. 1.
Figure 3:
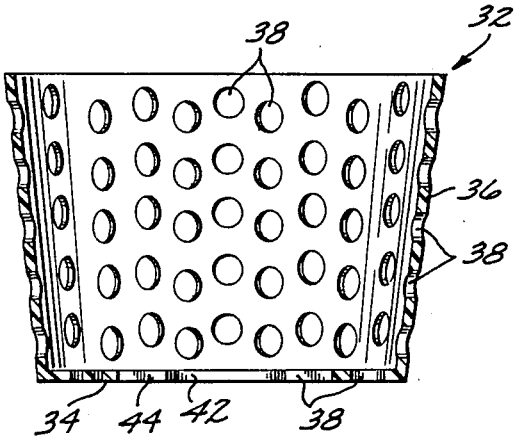
FIG. 3 is an enlarged view taken along the line 3—3 of FIG. 2.

As seen in FIGS. 1–3, the strainer is attachable to the drain plug stem and comprises a generally horizontally oriented bottom 34 and a peripherally continuous side wall 36 which together define an upwardly open container.

The strainer 32 is preferably made frusto-conical in configuration, with the larger diameter upper edge or rim dimensioned to fit closely adjacent and in freely slidable relation to the inner surface of the drain pipe 12. This permits up and down movement of the drain plug, but prevents the passage of small articles between the strainer and the drain pipe. Instead, the articles fall or are directed into the interior of the strainer.

The strainer side wall and bottom are foraminous, including a plurality of small circular openings 38. The openings can be of any shape or distribution so long as they are small enough to catch small articles, such as jewelry items and contact lenses, but large enough to allow a free flow of drain water through the strainer. A fine mesh material can be used to fabricate the strainer, if desired, a suitable strainer **32*a* of this type being illustrated in FIG. 5**. The mesh interstices define the small openings which permit filtered flow of waste water through the strainer.

The strainer is preferably made of a flexible, resilient material such as rubber or plastic material. Such a material having a low coefficient of friction would be particularly suitable.

Figure 4:
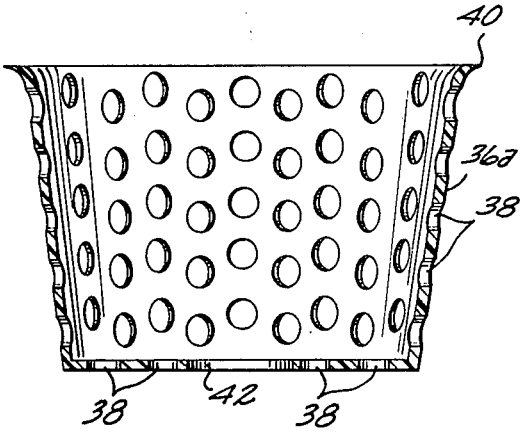
FIG. 4 is a view similar to FIG. 3, illustrating an embodiment of the strainer cup in which the upper or free edge of the cup is flared or feathered radially outwardly to limit its engagement with the drain pipe wall to the free edge.
Figure 5:
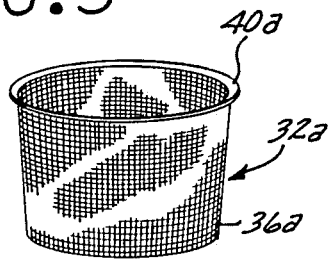
FIG. 5 is a perspective view similar to FIG. 1 but illustrating an embodiment of the strainer cup made of fine mesh material.

If desired, the upper edge or rim of the side wall 36 can be flared or feathered radially outwardly, as shown at 40 in the modified side wall **36*a* illustrated in FIG. 4. This further insures precise engagement between the strainer and the drain wall inner surfaces. Another option to provide improved close engagement is to make the upper edge or rim of flexible resilient material which is flared or feathered radially outwardly. Such a rim may take the form of a plastic ring 40*a* molded to the upper edge of the side wall, as seen in FIG. 5**.

Regardless of the version of strainer employed, it is unnecessary for the strainer to be in close engagement with the drain pipe wall throughout its entire height. All that is required is to provide a close engagement at the upper rim of the strainer to catch small articles, as compared to the strainer of Wentz (U.S. Pat. No. 4,380,834). It will be recalled that the Wentz strainer must have a precise, close fitting engagement with the drain pipe in any raised position of the drain plug in order to prevent entry of small articles into the strainer, and trap them in the sink before they pass into the drain opening. As will be apparent, it is far easier to provide a close tolerance fit between only a portion of the strainer and the drain pipe. Such tolerances are more easily achieved if the strainer is made of the flexible, resilient rubber or plastic material preferred by applicant.

Figure 6:
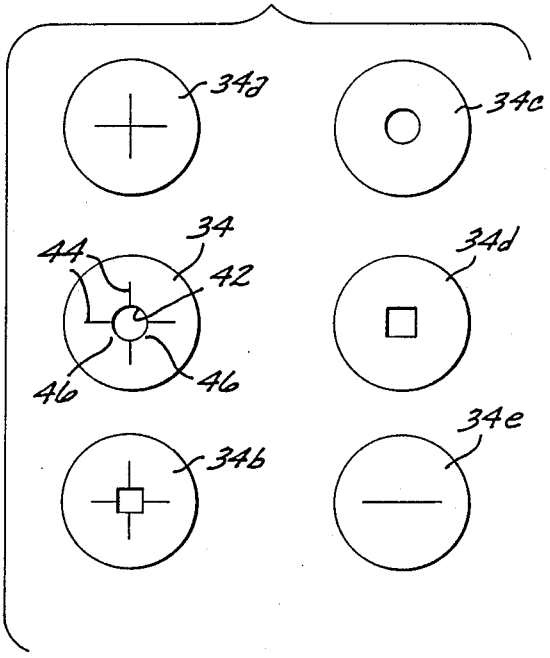
FIG. 6 is a series of partially diagrammatic bottom plan views of various embodiments of strainer cup, illustrating various configurations of central aperture systems which may be employed to enhance mounting of the strainer cups to various configurations of drain plug stem.

The strainer 32 includes central aperture means which adapt it for "universal" connection to variously configured drain plug stems. As seen in FIG. 6, the strainer bottom 34 is provided with such a means in the form of a central aperture 42 communicating with four radially directed cuts or slits 44. When the strainer bottom is forced over and past the plunger base 20 and onto the stem 30, aperture 42 receives the stem, and the slits 44 spread apart and deform downwardly to define gripping flaps 46, as seen in FIGS. 7 and 8. The aperture 42 is preferably made slightly smaller than the stem so that after it is stretched to fit over the larger diameter bulbous base 20 it will tightly grip the stem surfaces. This gripping, and the action of the flaps 46, provide good frictional engagement between the strainer and the drain plug stem for properly orienting the strainer and constraining it against any movement relative to the drain plug. If the strainer is made of metal, the gripping flaps 46 will have sharp edges which will dig or bite into the material of the stem and aid in constraining the strainer against relative movement.

The strainer bottoms 34*a–e* shown in FIG. 6 are illustrative of various central aperture means which can be provided to accommodate the strainer to various drain stem configurations. Sometimes only a single central aperture is necessary, whether round, square, etc., while in other instances the use of one or more slits, alone or in combination with a central aperture, is helpful. In any event, it will be apparent that an aperture means can be selected which is best suited to the particular application at hand.

The strainer cup is easily retrofitted to virtually any standard form of pop-up drain plug simply by positioning the larger open end of the strainer over the plug base until the base engages the central aperture means. The strainer is then forcibly urged upwardly until the aperture means passes over the base and onto the plug stem into firm gripping relation. Lowering the drain plug into the drain pipe with the strainer in place automatically orients the upper edge or rim of the strainer in close engagement with the inner surface of the drain pipe. Consequently, in the upper or open position of the drain plug, water draining from the sink necessarily passes into the open end of the strainer and out the strainer openings, and not between the strainer rim and the drain pipe. As a result, any small articles or foreign matter carried out of the sink by the drain water will fall into the strainer. From there the articles can easily be retrieved by pulling the drain plug out of the drain pipe and emptying the strainer cup.

Figure 11:
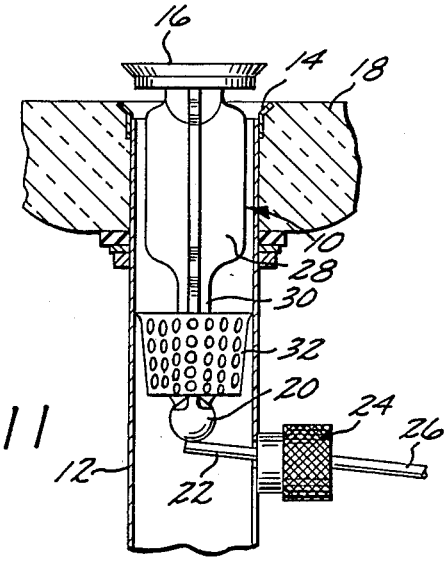
FIG. 11 is a perspective view of a second form of strainer mounted upon a drain and embodying the present invention.

Referring now to FIG. 11, there is shown a flat, horizontal, perforated strainer disc 50 which may be substituted for the strainer cup 32. Disc 50 may be formed of any suitable material, as for example, a wire mesh. The disc may also be provided with a small collar (not shown) to retain foreign material on the disc as it is pulled upwardly for cleaning. The straining means could also take the form of a concave disc (not shown). A suitable strainer could also be formed from a plurality of flexible or rigid radially extending fingers radiating outwardly from the stem. This form of strainer would offer but slight resistance to vertical plug movement, since only the ends of the fingers would touch the inside of the drain pipe. It should further be noted that any of the strainers can be rigidly attached to the stem 30.

From the foregoing it will be apparent that the strainer is easily fitted to various forms of pop-up drain plug to collect or catch articles which inadvertently pass out of the sink with the drain water, and the strainer does not affect the normal operation of the drain system.

Various modifications and changes may be made with regard to the foregoing detailed description without departing from the spirit of the present invention.

What is claimed is:

1. A strainer for a pop-up drain plug characterized by a cap at one end to seal the entry opening of a drain pipe; a base at the other end engagable by actuator means to move the plug up and down within the drain pipe; and an intermediate portion comprising a finned guide adjacent the cap for engaging the drain pipe wall to guide the plug during its up and down movement, and further comprising a stem between the guide and the base, the stem being of lesser cross section that the guide, the base having an enlarged size with respect to said stem, the strainer comprising:

an annular member being of such a size as to have a close fitting, freely slidable engagement with the drain pipe wall to catch small articles passing through the entry opening and into the drain pipe, said member being formed with a horizontal bottom wall having a plurality of relatively small openings for allowing water to drain from the annular member without loss of small articles caught in the annular member, the horizontal wall being formed of a resilient material having formed therein slits extending outwardly from the center of the horizontal wall which define a plurality of gripping flaps which spread apart upon sliding of the annular member upwardly over the plug base onto the plug stem to be deformed downwardly against the base of the stem for tightly, resiliently engaging the stem and thereby properly orienting the annular member, during use in the drain pipe, while constraining said member against vertical movement relative to the drain plug.

2. A strainer according to claim 1 wherein the annular member is cup-shaped.

3. A strainer cup according to claim 2 wherein the upper edge of the cup side wall includes a larger diameter rim dimensioned for precise, slidable and close fitting engagement with the walls of the drain pipe.

4. A strainer for a pop-up drain plug characterized by a cap at one end to seal the entry opening of a drain pipe; a base at the other end engagable by actuator means to move the plug up and down within the drain pipe; and an intermediate portion comprising a finned guide adjacent the cap for engaging the drain pipe wall to guide the plug during its up and down movement, and further comprising a stem between the guide and the base, the stem being of lesser cross section than the guide, the base having an enlarged size with respect to said stem, the strainer comprising:

an annular member being of such size as to have a close fitting, freely slidable engagement with the drain pipe wall to catch small articles passing through the entry opening and into the drain pipe, said member being formed with a disc-shaped horizontal bottom wall having a plurality of relatively small openings for allowing water to drain from the annular member without loss of small articles caught in the annular member, the horizontal wall being formed of a resilient material having formed therein a plurality of interjoined radially arranged slits which form a plurality of gripping flap which spread apart upon sliding of the center of the horizontal wall upwardly over the plug base onto the plug stem to be deformed downwardly against the base of the stem for tightly, resiliently engaging the stem and thereby properly orienting the annular member during use in the drain pipe while constraining said member against vertical movement relative to the drain plug.

5. The strainer of claim 4 wherein:

the center of the horizontal wall is additionally formed with an aperture from which the slits extend.

6. A strainer for a pop-up drain plug characterized by a cap at one end to seal the entry opening of a drain pipe; a base at the other end engagable by actuator means to move the plug up and down within the drain pipe; and an intermediate portion comprising a finned guide adjacent the cap for engaging the drain pipe wall to guide the plug during its up and down movement, and further comprising a stem between the guide and the base, the stem being of lesser cross section than the guide, the base having an enlarged size with respect to said stem, the strainer comprising:

an annular member being of such size as to have a close fitting, freely slidable engagement with the drain pipe wall to catch small articles passing through the entry opening and into the drain pipe, said member being formed with a horizontal bottom wall having a plurality of relatively small openings for allowing water to drain from the annular member without loss of small articles caught in the annular member, the horizontal wall being formed of a resilient material having formed therein a central aperture with slits extending radially outwardly therefrom to form a plurality of gripping flaps which, spread apart upon sliding of the center of the horizontal wall upwardly over the plug base onto the plug stem to be deformed downwardly against the base of the stem for tightly, resiliently, engaging the stem and thereby properly orienting the annular member during use in the drain pipe while constraining said member against vertical movement relative to the drain plug.

* * * * *